US006405576B1

(12) United States Patent
Endo et al.

(10) Patent No.: US 6,405,576 B1
(45) Date of Patent: Jun. 18, 2002

(54) LINEAR SLIDE PRESS MACHINE

(75) Inventors: Kenichi Endo; Shozo Imanishi, both of Sagamihara (JP)

(73) Assignee: Aida Engineering Co., Ltd. (JP)

( * ) Notice: Subject to any disclaimer, the term of this patent is extended or adjusted under 35 U.S.C. 154(b) by 0 days.

(21) Appl. No.: 09/526,422

(22) Filed: Mar. 15, 2000

(30) Foreign Application Priority Data

Nov. 30, 1999 (JP) ..... 11-339964

(51) Int. Cl.[7] ..... B21J 9/18; B30B 1/06; B30B 5/00

(52) U.S. Cl. ..... 72/451; 72/450; 100/257; 100/286

(58) Field of Search ..... 72/450, 451; 100/281, 100/282, 284, 285, 286, 257

(56) References Cited

U.S. PATENT DOCUMENTS 4,160,409 A * 7/1979 Portmann ..... 100/257
5,052,257 A * 10/1991 Eigenmann ..... 100/257
5,531,160 A * 7/1996 Eigenmann ..... 100/258 R
5,746,123 A * 5/1998 Eigenmann ..... 100/208
5,848,568 A * 12/1998 Imanishi ..... 100/257
6,055,903 A * 5/2000 Eigenmann ..... 100/257
6,112,571 A * 9/2000 Tung ..... 100/286

* cited by examiner

*Primary Examiner*—David Jones
(74) *Attorney, Agent, or Firm*—Morrison Law Firm

(57) ABSTRACT

A slide-type pressing machine has a stroke length adjustment mechanism in which: changing of the stroke length does not effect the bottom dead center position of the press, adjustment is simplified, and the press is suitable for high speed pressing operations. The slide-type pressing machine has an eccentric section of a crank shaft which causes a slider to move up and down. An arm extends past a fixed pivot of an upper toggle link. One end of the arm is connected to the slider by a connecting link. A drive link and a drive connecting link are connected by a connecting pivot. A worm wheel is disposed on a frame, and is concentric with the connecting pivot when the slide is at bottom dead center. The worm wheel is arranged so that its rotation angle can be adjusted. A second arm is disposed in a radial direction from the axis of the worm wheel. A second pin is located at an end of the second arm. The second pin is connected to the connecting pivot via a third link. The motion of the connecting pivot is restricted to either an arcuate or linear path. The position of the second pin is changed to adjust the stroke length of the slide and the bottom dead center is kept fixed.

14 Claims, 11 Drawing Sheets

LINEAR SLIDE PRESS MACHINE

BACKGROUND OF THE INVENTION

The present invention relates to slide type press machine. More specifically, the present invention provides for a press machine having a slide that moves linearly in a vertical direction through the use of a toggle link. The present invention is useful when the stroke-length for a slide needs to be changed with a large change ratio or when the bottom dead center needs to be adjusted.

An example of a press machine that provides linear vertical motion of a slide is found in Japanese examined patent publication number 7-55399. This press provides linear vertical motion of a slide by converting the rotation of an eccentric section of a crank shaft to a linear reciprocating motion. The linear reciprocating motion is transferred, via a connecting link, to a central connecting pin which connects an upper and lower toggle link. In this example, the rotation of the eccentric section of the crank shaft is converted to the linear reciprocating motion of a slider via a connecting piece. The slide and the central connecting pin are connected on either side of a first link and a second link. This provides for vertical motion of the slide. An externally threaded screw connects a third link and a fourth link. The third and fourth links for a parallelogram with the first and second links. The externally threaded screw is used to adjust vertical positioning, thus adjusting the stroke-length and the bottom dead center of the slide.

In Japanese laid-open patent publication number 48-42471, there is disclosed a stroke-length adjustment mechanism where an eccentric shaft is fixed with a lock pin so that the stroke-length can be changed in two stages.

Another press machine is disclosed in Japanese examined patent publication number 7-55399. In this press machine, the vertical motion of the externally threaded screw provides adjustment by changing the shape of the first link through the fourth link, which form a parallelogram. Increasing the adjustment length of the externally threaded screw provides only a small change ratio for the slide stroke-length of about 4. With the change in the slide stroke-length, there is also a large displacement in the bottom dead center. Thus, even if fine adjustments of the bottom dead center are possible for a specific stroke-length, the change ratio of the stroke-length will be small. Thus, a restriction is imposed on the height of the die.

In presses that use toggle links, there is generally high acceleration at the point of reversal at the bottom dead center of the slide. This makes high-speed operation difficult.

A stroke-length adjustment mechanism in a press machine is disclosed in Japanese laid-open patent publication number 48-42471. This conventional stroke-length adjustment mechanisms cannot be changed continuously. In the press disclosed in Japanese examined patent publication number 7-55399, the stroke-length can be changed continuously by using a screw mechanism in the stroke-length adjustment mechanism. However, in this case, the press load will be applied to the screw mechanism during press operation, requiring the screw mechanism to have a sturdy structure. The device must be made larger in order to provide a sturdy structure, resulting in increased production costs.

OBJECTS AND SUMMARY OF THE INVENTION

It is an object of the present invention is to provide a press machine which overcomes the problems of the prior art.

It is another object of the present invention to provide a press machine having a compact design.

It is yet another object of the present invention to provide a press machine having a slide with an adjustable stroke-length.

It is still another object of the present invention to provide for a press machine having an adjustable bottom dead center position.

It is an object of the present invention to provide a press machine that has a large change ratio for the slide stroke-length, allows fine adjustments of the bottom dead center, and uses a toggle link having a low acceleration at the bottom dead center to raise and lower the slide.

It is a further object of the present invention to provide a press machine where the stroke-length can be changed continuously, reducing the press load applied to the screw mechanism used in the stroke-length adjusting mechanism, thus permitting a compact design.

Briefly stated, a pressing machine has a stroke length adjustment mechanism in which: changing of the stroke length does not effect the bottom dead center position of the press, adjustment is simplified, and the press is suitable for high speed pressing operations. The slide-type pressing machine has an eccentric section of a crank shaft which causes a slider to move up and down. An arm extends past a fixed pivot of an upper toggle link. One end of the arm is connected to the slider by a connecting link. A drive link and a drive connecting link are connected by a connecting pivot. A worm wheel is disposed on a frame, and is concentric with the connecting pivot when the slide is at bottom dead center. The worm wheel is arranged so that its rotation angle can be adjusted. A second arm is disposed in a radial direction from the axis of the worm wheel. A second pin is located at an end of the second arm. The second pin is connected to the connecting pivot via a third link. The motion of the connecting pivot is restricted to either an arcuate or linear path. The position of the second pin is changed to adjust the stroke length of the slide and the bottom dead center is kept fixed.

According to an embodiment of the invention, there is provided for a press including a slider, the slider being driven to move vertically from rotation of a crank shaft via a connecting rod, a drive link connected to one end of the slider, an upper toggle link pivotably supported at one point by a fixed pivot, connected at one end to the drive connecting link, and connected at another end to a slide via a link member, and a stroke adjusting mechanism restricting a pivoting motion of a pivot connecting the drive link and the drive connecting link. This embodiment of the invention can provide: a larger change ratio for the stroke-length than found in conventional press machines, an adjustable die height, and the stroke-length can be adjusted while leaving the bottom dead center unchanged. Thus, fine adjustments to the bottom dead center, known as bottom dead center correction, can be performed while the press is operating. Machine vibration is reduced since there is no extreme increase in acceleration at the top dead center, thus allowing the use of this invention in presses that require high-speed operation. Since a certain amount of space can be provided between the link members connecting the crank shaft and the slide, the design of the pitch between points is more flexible.

Furthermore, by changing the position of the pivot connecting the drive link and the drive connecting link when the press is at top dead center, a "quick lift" feature is made available for the press. A quick lift feature is a feature for presses with short stroke-lengths wherein the slide can be temporarily raised for maintenance of the die or the like. Then the distance between dies can be increased. Once maintenance is complete, the original die height can be restored.

According to another embodiment of the invention, there is provided for a press machine having a stroke-length adjusting mechanism including a connecting pivot projected from a drive link, a third link connected at one end to the connecting pivot, a shaft pivotably supported by a frame, a second arm fixed at one end to the shaft and connected at another end to another end of the third link, and means for rotating the shaft. This embodiment of the invention provides for a press that has a simple structure and that includes a stroke-length adjusting mechanism with reduced production costs compared to conventional technology.

According to yet another embodiment of the invention, there is provide for a press machine having means for rotating a shaft, the means for rotating including a worm wheel fixed to the shaft, and a worm shaft meshing with the worm wheel. With this embodiment, stroke-length adjustments can be performed continuously and a more compact means for rotating the shaft is possible.

According to an embodiment of the invention, there is provide for a press machine a stroke-length adjusting mechanism which has means for fixing a shaft, the means for fixing including: a fixing cylinder movably fitting with the shaft, a jaw disposed on the shaft restricting a displacement distance of the fixing cylinder, and means for supplying pressurized oil to the jaw and the fixing cylinder. With this embodiment of the invention, the shaft connected to the rotating means can be fixed, reducing the effect that press loads generate on the rotating means during pressing operation.

According to another embodiment of the invention, there is provided for a press machine having a stroke-length adjusting mechanism, the stroke-length adjusting mechanism including: a pin projecting from a drive link, a gear on which is disposed a guide groove in which is movably fitted the pin, and means for adjusting gear angle for adjusting a rotation angle of the gear. With this invention, the stroke-length can be determined by the rotation angle of the gear, i.e., the rotation angle of the guide groove. Thus, a stroke-length adjusting mechanism can be provided with reduced production costs.

According to the present invention, there is provided for a press comprising: a slider, the slider is moveable along a vertical axis, a crank shaft, a connecting rod, the connecting rod couples a rotation of the crank shaft to the slider such that the slider moves along the vertical axis in response to a rotation of the crank shaft, a drive link, the drive link having one end, the one end of the drive link is coupled to the slider, a drive connecting link, the drive connecting link having one end, the one end of the drive connecting link is coupled to the drive link, an upper toggle link, the upper toggle link having one end and another end, a fixed pivot, the upper toggle link is pivotably supported at one point by the fixed pivot, the one end of the upper toggle link is coupled to the drive connecting link, a link member, the another end of the upper toggle link is coupled to the slide via the link member, and a stroke length adjusting mechanism restricting a pivoting motion of a pivot connecting the drive link and the drive connecting link.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Referring to FIG. 1 through FIG. 12, the following is a description of the embodiments of a press machine according to the present invention.

Figure 1A:
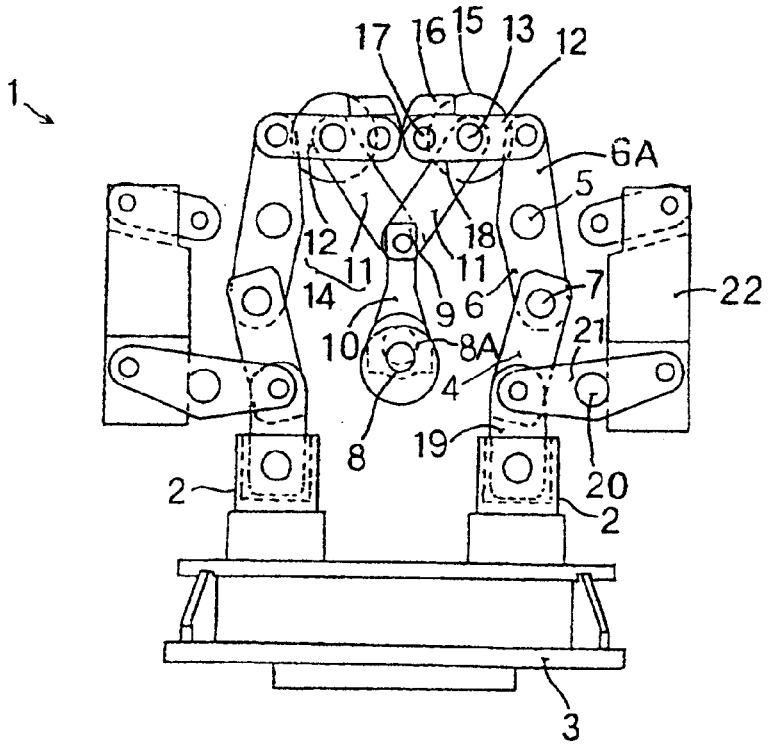
FIG. 1(A) is a schematic front-view drawing of a press machine according to a first embodiment of the invention.
Figure 1B:
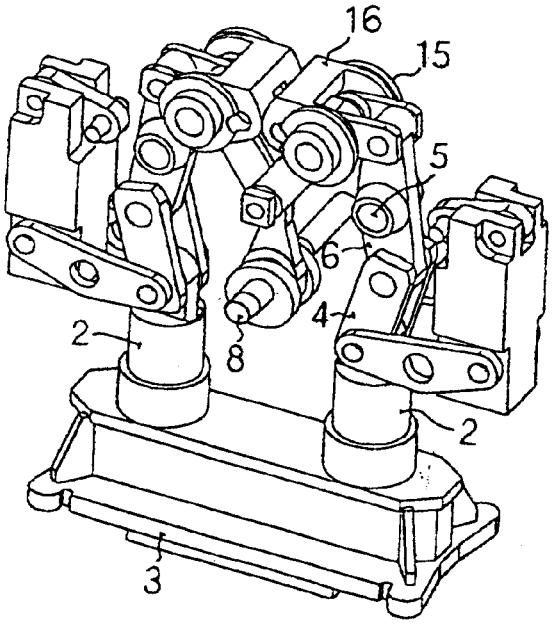
FIG. 1(B) is a schematic perspective drawing of a press machine according to a first embodiment of the invention.
Figure 2:
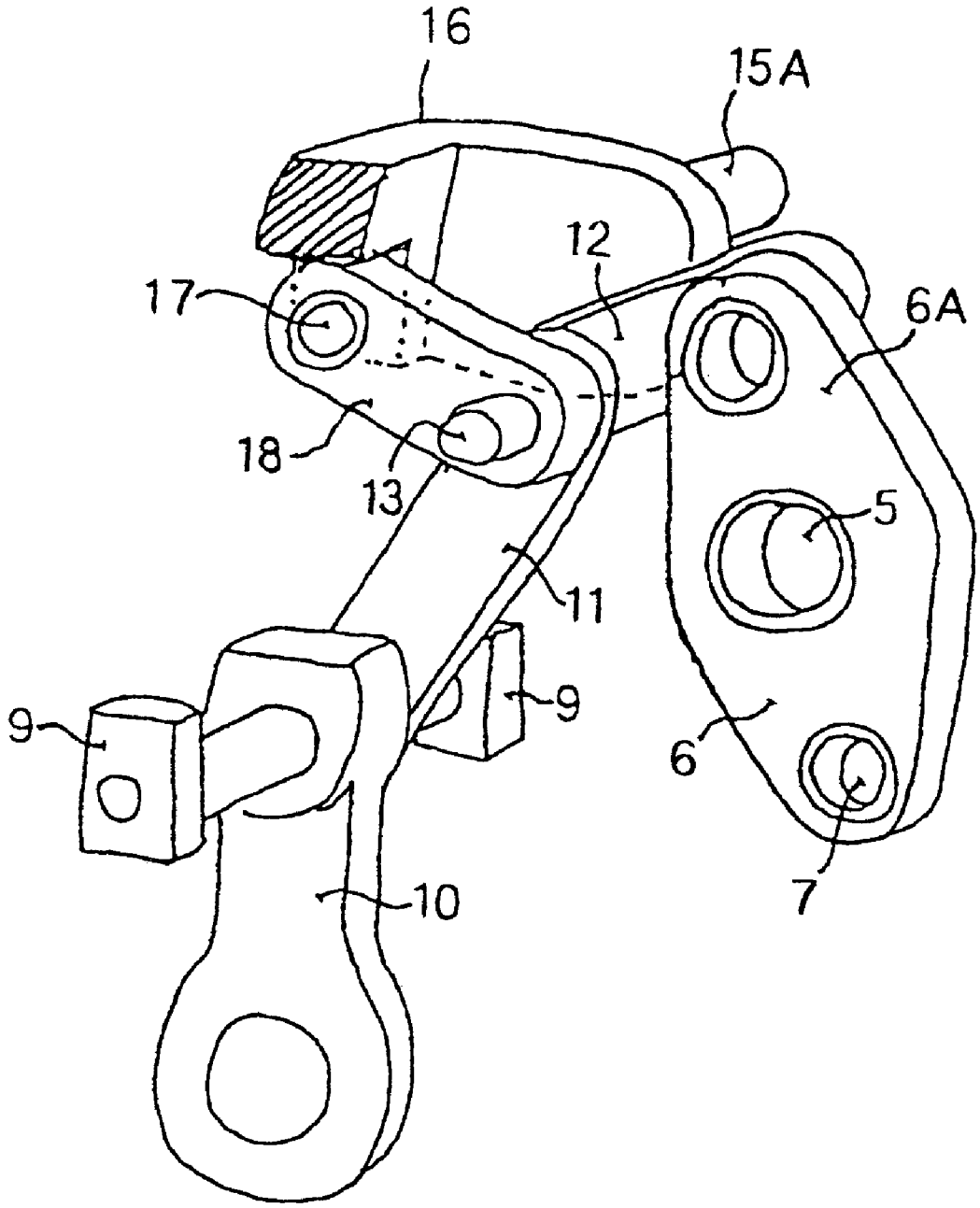
FIG. 2 is a perspective drawing showing a connecting section of a third link according to a first embodiment of the invention.

A first embodiment of the invention is shown in FIGS. 1 and 2. A press machine 1 has a slide 3 which is guided by a frame (not shown in the figures) so that it can move vertically. A lower toggle link 4 is connected to a slide 3. An upper toggle link 6 is connected to a fixed pivot 5 of the frame. A toggle link is formed by connected an upper end of lower toggle link 4 to a bottom end of upper toggle link 6 via a central connecting pin 7.

A crank shaft 8 has an eccentric section 8A. A connecting rod 10 connects a slider 9 to eccentric section 8A. This arrangement permits vertical motion of slider 9. Upper toggle link 6 includes an arm 6A which extends past fixed pivot 5 and is connected to slider 9 by a connecting link 14. Connecting link 14 includes a drive link 11 and a drive connecting link 12 which are connected at a connecting pivot 13.

The structure described above is disposed at each of the two points 2, 2 of slide 3 to provide a connection with slider 9. Referring to FIG. 1(*a*), a worm wheel 15 is rotatably disposed on the frame so that it is concentric with connecting pivot 13 when slide 3 is at bottom dead center, i.e., when the eccentric section 8A is positioned above crank shaft 8. A second arm 16 extends radially from a shaft 15A of worm wheel 15. A second pin 17 is disposed at an end of second arm 16. A third link 18 connects second pin 17 and connecting pivot 13.

A detailed perspective drawing of the above described structure is shown in FIG. 2. Slider 9 moves vertically in response to the rotation of eccentric section 8A of crank shaft 8. The motion of connecting pivot 13 is restricted along an arc which is centered around second pin 17 and having third link 18 as its radius. The toggle link formed by drive link 11 and drive connecting link 12 causes slide 3 to move vertically.

Referring to FIG. 3, a worm gear 36 is disposed on the frame. Worm gear 36 controls the rotation angle of worm wheel 15. The stroke length of slider 3 can be changed by moving the position of second pin 17 around shaft 15A. At the bottom dead center of slide 3, the center of shaft 15A of worm wheel 15 is aligned with the center of connecting pivot 13. The stroke length adjusting mechanism includes: drive link 11; connecting pivot 13; third link 18; shaft 15A; second arm 16; and rotating means for rotating shaft 15A. The rotating means includes the worm wheel 15 and the worm shaft 36. Thus, the adjusting mechanism permits adjustment of the stroke length while maintaining the bottom dead center at an unchanging fixed position.

Worm wheel 15 is disposed on the frame such that the center thereof is slightly offset from connecting pivot 13 of slide 3 at bottom dead center. By changing the position of worm wheel 15, the position of second pin 17 relative to shaft 15A is also changed. Thus, by changing the position of worm wheel 15, the stroke length of slide 3 is changed and the bottom dead center position is also slightly changed. Fine adjustments can be made to the position of second pin 17 in order to make fine adjustments on the bottom dead center of slide 3.

Slide 3 and lower toggle link 4 are connected by a slide drive link 19. Dynamic equilibrium drive link 21 is pivotably disposed on a second fixed pivot 20. One end of dynamic equilibrium drive link 21 is connected to the bottom end of lower toggle link 4, while another end of dynamic equilibrium drive link 21 is connected to a dynamic equilibrium weight 22. The pivoting of dynamic equilibrium drive link 21 causes dynamic equilibrium weight 22 to move up and down so that inertia from the motion of slide 3 can be kept in dynamic equilibrium.

FIRST EMBODIMENT

A first embodiment of the invention is shown in FIGS. 1(A), 1(B), 2, 3(A) and 3(B). In the first embodiment, when slide 3 is positioned at the bottom dead center position, second arm 16 can be rotated to the maximum angle within the valid angular range. Rotation of second arm 16 changes the position of second pin 17, and thus changes the pivot for drive link 11 and connecting drive link 12. This provides a "quick lift" function that allows quick access to the die (not shown in the figure) attached to slide 3 and to a bolster (also not shown in the figure). Slide 3 can be moved upward while keeping the die height setting set up for the pressed product using the slide adjusting device. The die height can subsequently be accurately restored to the original position.

In addition, the first embodiment of the invention provides that a pin projected between connecting pivot 13 and drive link 11 is positioned at the same position as connecting pivot 13. However, the pin may be positioned anywhere between connecting pivot 13 and drive link 11.

Figure 3A:
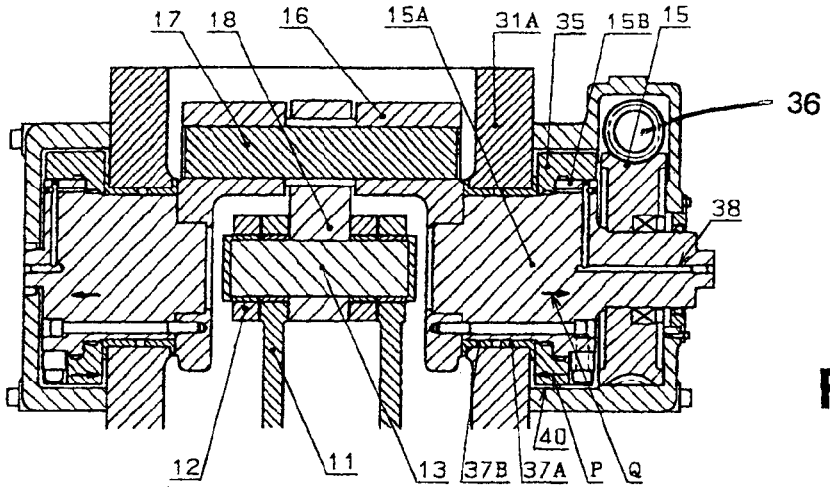
FIG. 3(A) is a cross-section along the AA line of FIG. 3(B).
Figure 3B:
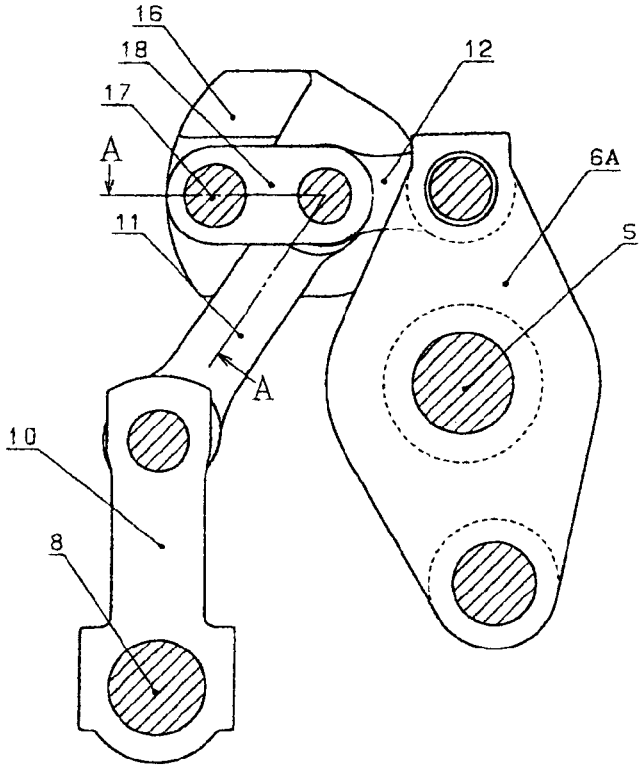
FIG. 3(B) is a front-view drawing of a connecting section of a third link according to a first embodiment of the invention.

FIG. 3(A) provides a detailed drawing of a fixing means 40 for shaft 15A. Fixing means 40 protects worm wheel 15 and worm shaft 36 by preventing shaft 15A from turning when under a press load.

A fixing cylinder 35 is disposed on fixing means 40. Fixing cylinder 35 is movably fitted to shaft 15A along an axial direction. A bushing 37A, 37B is disposed on a frame 31A to support shaft 15A. A jaw 15B is disposed on shaft 15A. Bushing 37A, 37B and jaw 15B restrict displacement of fixing cylinder 35 to a very small distance. Fixing cylinder 35 is activated by hydraulic pressure. An oil path 38 is disposed on shaft 15A to provide the hydraulic pressure for driving fixing cylinder 35.

During a pressing operation, pressurized oil is fed to oil path 38 in order to fix shaft 15A, causing fixing cylinder 35 to move in a direction P. As more pressurized oil is supplied, the action of the pressurized oil causes fixing cylinder 35 to be pushed toward bushing 37A while shaft 15A receives a force in a direction Q. Since second arm 16 is fixed to shaft 15A, movement of second arm 16 is pushed toward bushing 37B. As a result of the above operation, shaft 15A is maintained in a fixed position.

Second arm 16 receives a tensile force from left and right shafts 15A via the second pin, causing the second arm to deform. The deformation in the second arm is minimal and has almost no effect on the operation of the press.

As discussed above shaft 15A is maintained in a fixed position during a pressing operation of the press. Although the press load applies a rotating force on shaft 15A, via second arm 16, shaft 15A is maintained in a fixed position. Since shaft 15A is maintained in a fixed position during the pressing operation, worm wheel 15 does not rotate. Thus, worm wheel 15 and worm shaft 36 are protected during the pressing operation.

SECOND EMBODIMENT

Figure 4A:
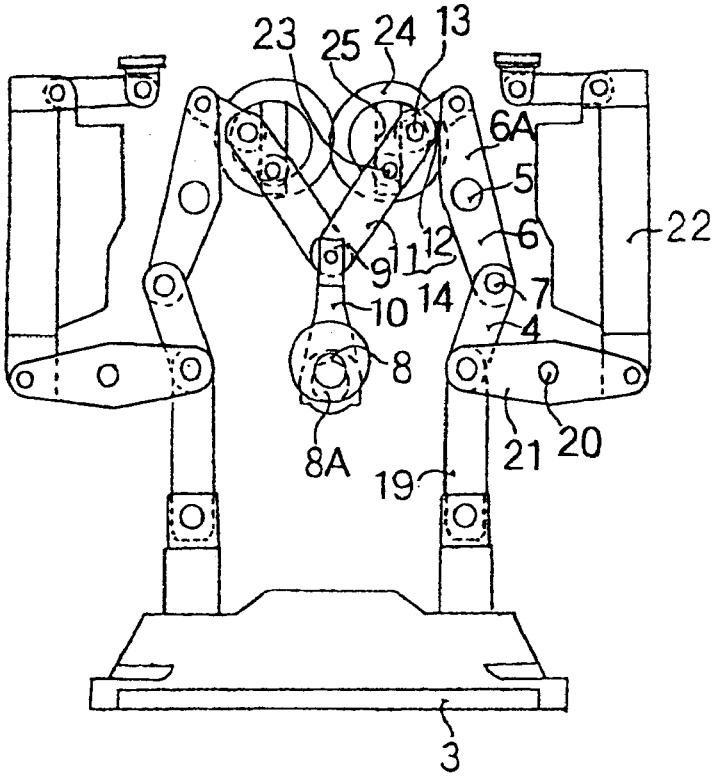
FIG. 4(A) is a schematic front-view drawing of a press machine according to a second embodiment of the invention.
Figure 4B:
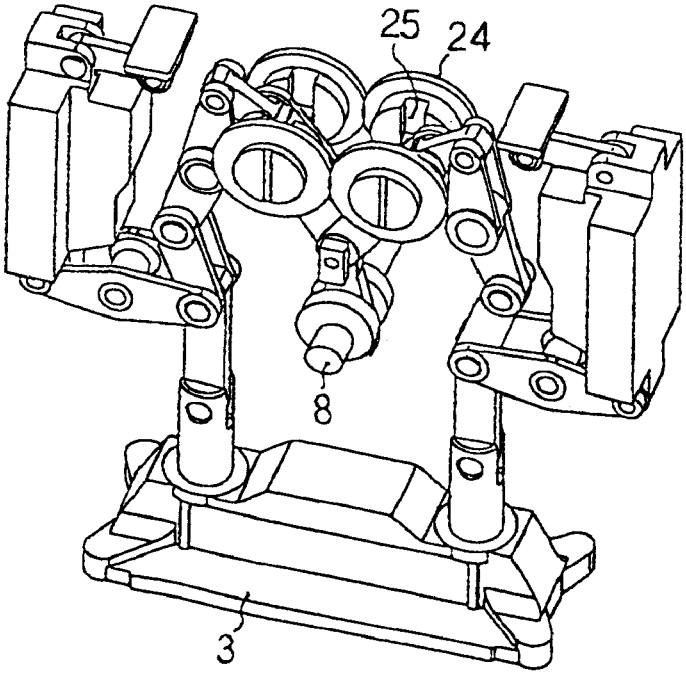
FIG. 4(B) is a schematic perspective drawing of a press machine according to a second embodiment of the invention
Figure 5:
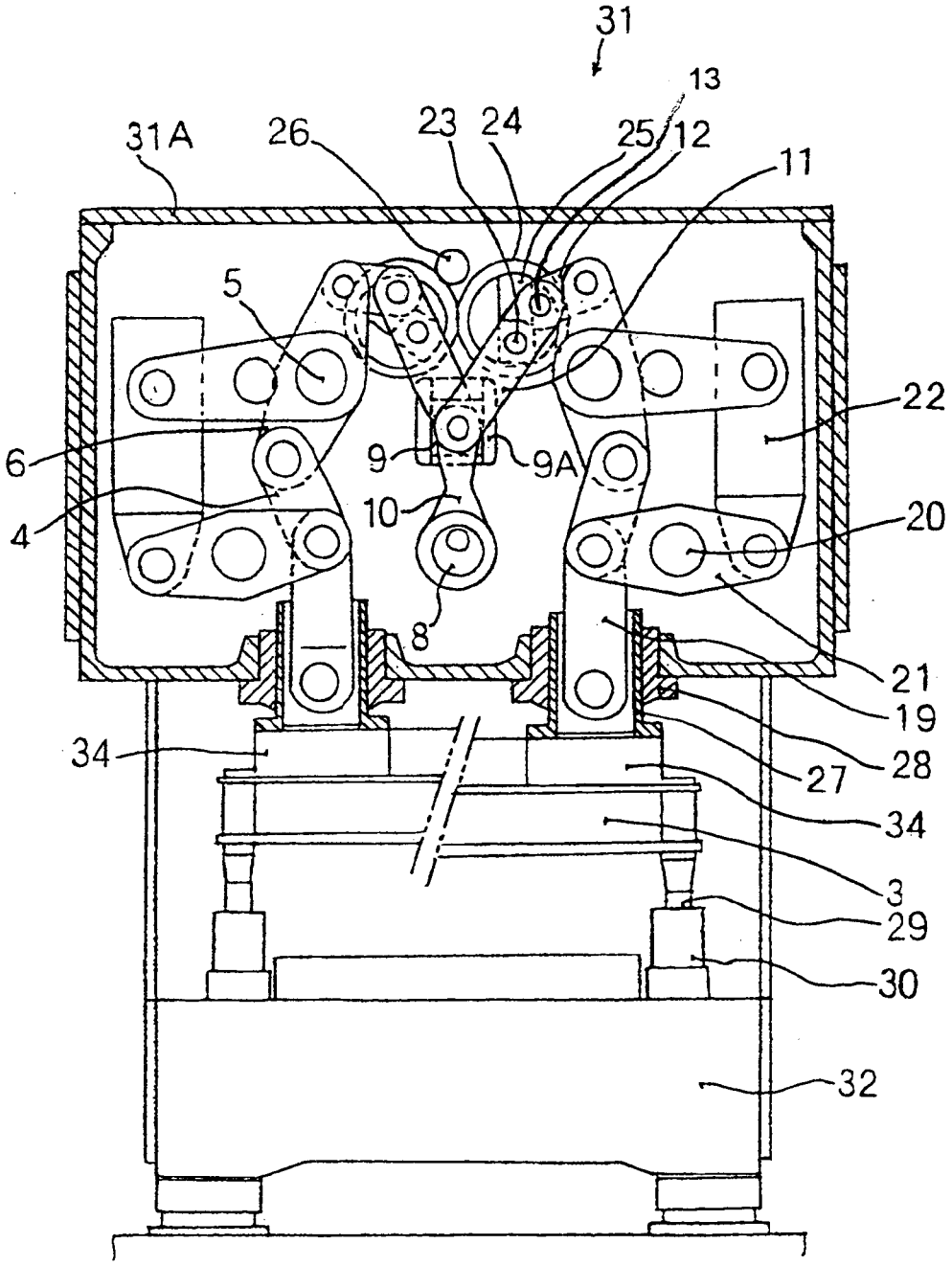
FIG. 5 is a schematic front-view drawing of an entire press machine according to a second embodiment of the invention.

A second embodiment of the invention is shown in FIGS. 4–5. The structure for moving slide 3 vertically through the rotation of eccentric section 8A of crank shaft 8 is similar to that found in the first embodiment discussed previously. The structure for maintaining dynamic equilibrium of slide 3 through the dynamic equilibrium weight 22 is also similar to that found in the first embodiment. For the structures which are similar to that found in the first embodiment of the invention, like elements will be given like numerals and the descriptions will be omitted. The description which follows below only discusses the differing structures.

As shown in FIG. 4(A), an eccentric section 8A is positioned below crank shaft 8. This differs from the first embodiment in that slide 3 is positioned at the bottom dead center. However, the operations performed are similar to those found in the first embodiment.

Now referring to FIGS. 4(A) and 4(B), a pin 23 projects from drive link 11 towards slider 9. Pin 23 is located at an intermediate position along drive link 11. Pin 23 is guided and restricted by a linear guide groove 25. Linear guide groove 25 is disposed on a side surface of a gear 24. Gear 24 is disposed on a frame 31A (See FIG. 3(A)). The center of gear 24 is positioned so that it is aligned with the center of pin 23 when slide 3 is at bottom dead center with eccentric section 8A of crank shaft 8 positioned up. Gear 24 is rotatably disposed on frame 31A.

Fine adjustments can be made to the angle of gear 24 through the use of means for adjusting a gear angle. One example of means for adjusting the gear angle includes: a pinion formed on a drive shaft that meshes with gear 24, a motor, and an encoder disposed on the motor such that the encoder can detect a rotation angle.

According to the second embodiment of the invention, guide groove 25 is disposed on the side surface of gear 24 where the guide groove is linear. However, it is understood that other guide groove shapes are possible including arcuate shapes.

The stroke length and the bottom dead center position of slide 3 can be changed by adjusting the angle of gear 24 and changing the slope of guide groove 25. As in the first embodiment of the invention, the center of gear 24 can be offset from center pin 23 (e.g., providing a slight vertical offset). Fine adjustments can be made to the bottom dead center of slide 3 by rotating gear 24 and changing the slope of guide groove 25 by a slight amount.

As in the first embodiment, the pivot for drive link 11 and connecting drive link 12 can be changed in the second embodiment. The position of second pin 17 is changed by positioning slide 3 at bottom dead center and rotating second arm 16 to a maximum angle within a specified valid range. By changing the position of second pin 17, the pivot and connecting drive link are changed. This provides a "quick lift" function that allows quick access to a die (not shown) which is attached to slide 3 and to a bolster (not shown).

The slide adjusting device allows slide 3 to be moved upward while maintaining a particular die height setting. The die height setting corresponds to a particular pressing height for a particular pressed product. The slide adjusting device permits the slide to be lifted up allowing access to the die. After the die is accessed and/or replaced, the die height can be accurately restored to it's original position.

The above discussed second embodiment of the invention can be mounted to a frame of a pressing machine. As shown in FIG. 5, a slide type pressing machine according to a second embodiment of the invention is mounted in the frame 31A of a press 31. The pinion 26, which meshes with the gear 24, provides rotation adjustment of the gear 24.

Although FIG. 5 depicts gears 24, 24 meshing with each other, it is also be possible to change the design as appropriate based on the distance between the left and right points of press 31. Additionally, the same results can be obtained if pin 23 is disposed on drive link 11 between the position aligned with connecting pivot 13 or another position which is further away. Similar design changes can also be made with worm wheel 15 from the first embodiment.

Several drive systems, for vertically moving slide 3 disposed on the frame 31A, are described above. In each drive system, slide 3 is moved up and down by a plunger 27. Frame 31A includes a bed 32. A Post 29 is guided by a post guide 30 downward towards bed 32. A guide 28 is disposed on a frame 2. Guide 28 guides plunger 27 at a point position. A slide adjusting device 34 is disposed on the upper surface of slide 3.

Figure 6:
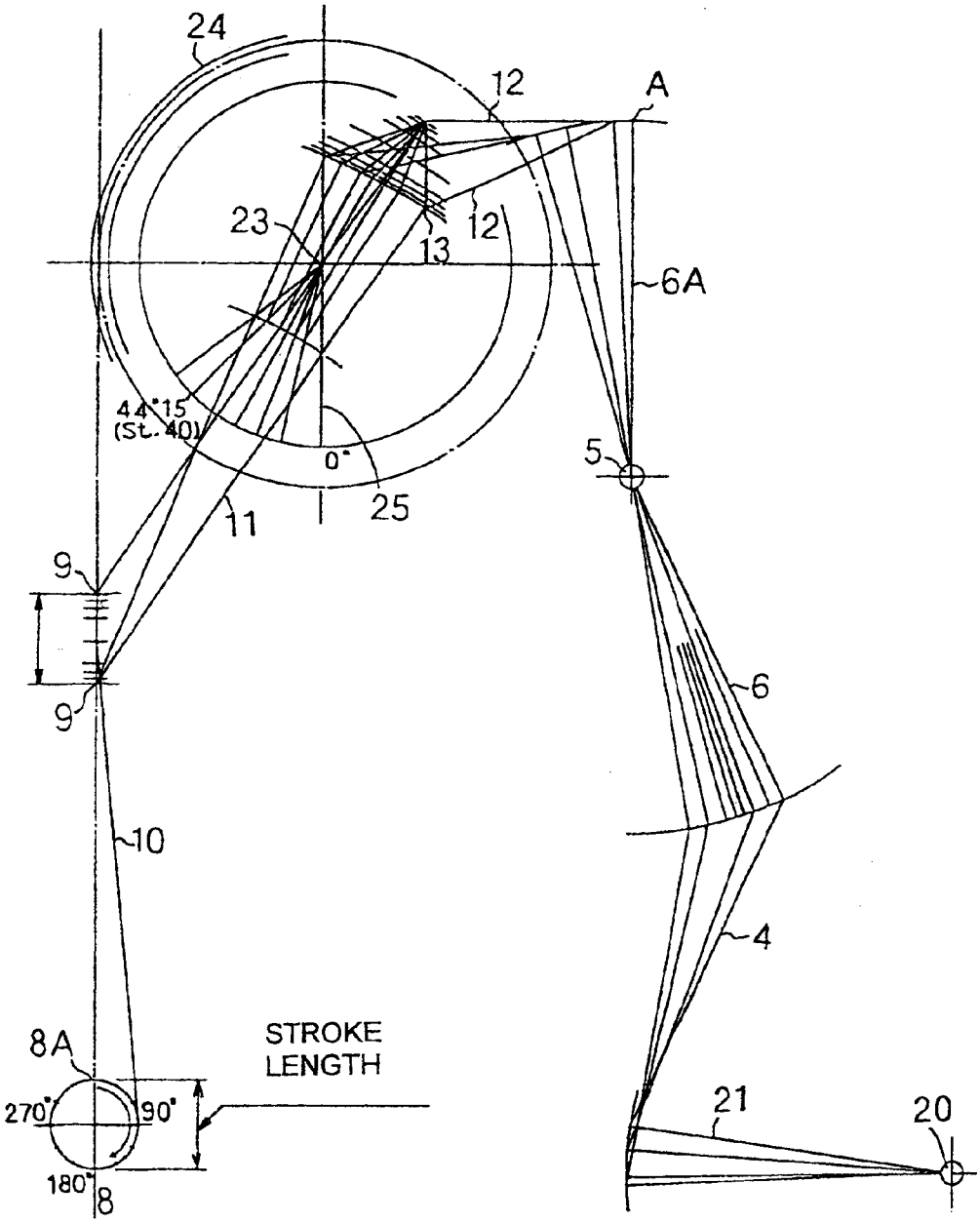
FIG. 6 is a kinematic drawing of a drive mechanism according to a second embodiment of the invention.

Referring now to FIG. 6, there is shown a kinematic diagram of a drive mechanism designed according to a second embodiment of the invention. In this figure, the angle of gear 24 is adjusted and the slope of guide groove 25 is changed to a downward angle of 0°. A change in the stroke length of slide 3 results from the rotation of crank shaft 8. The change in stroke length is shown as the motion between where slide 9 is at it's bottom end, at a position corresponding to the top dead center position of slide 3, and where slide 9 is at it's upper end, at a position corresponding to the bottom dead center position of slide 3.

As slider 9 moves vertically, pin 23 also moves. The movement of pin 23 is restricted by guide grooves 25, which have had their incline angles adjusted. At the bottom dead center of slide 3, the center of pin 23 is always aligned with the center of gear 24. Thus, the connecting section between drive connecting link 12 and arm 6A of upper toggle link 6 is at a fixed position, and the bottom dead center of slide 3 is maintained at a fixed position.

Figure 10A:
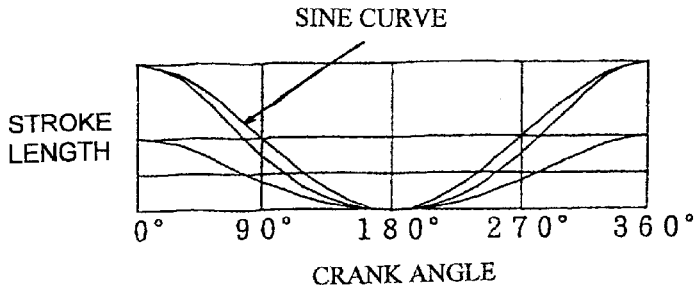
FIG. 10(A) is a slide stroke line graph based on a second embodiment of the invention.

FIG. 10(A) shows a stroke line graph of a slide 3 which is designed according to the second embodiment of the invention described above. The stroke line graph shows that in a press that uses a toggle link based on this drive mechanism, the stroke line has a gentle curve around the top dead center where the crank angle is 0°. The acceleration from the change of direction of slide 3 at the top dead center is small, thus allowing high-speed operation. Also, the stationary interval at the bottom dead center (crank angle 180°) is an appropriate length. Even if the stroke length of slide 3 is changed, only the scale of these characteristics will change, and there will be no major geometric changes in the shape of the line graph.

Figure 10B:
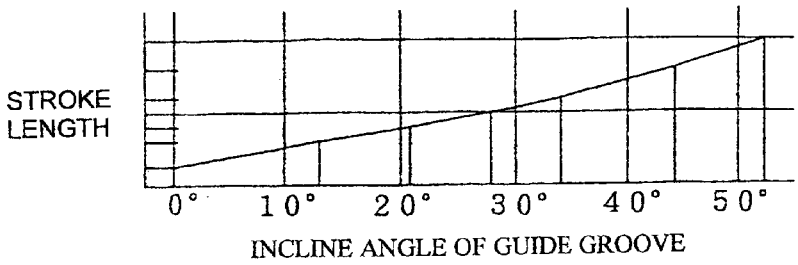
FIG. 10(B) is a figure showing the relationship between an incline angle and a slide stroke based on a second embodiment of the invention.

FIG. 10(B) shows the relationship between the stroke length of slide 3 and the incline angle of guide groove 25.

In FIG. 6, crank shaft 8 is disposed above slider 9. Thus, the crank angles of 180° for the top dead center and 0° for the bottom dead center will be reversed.

Figure 7:
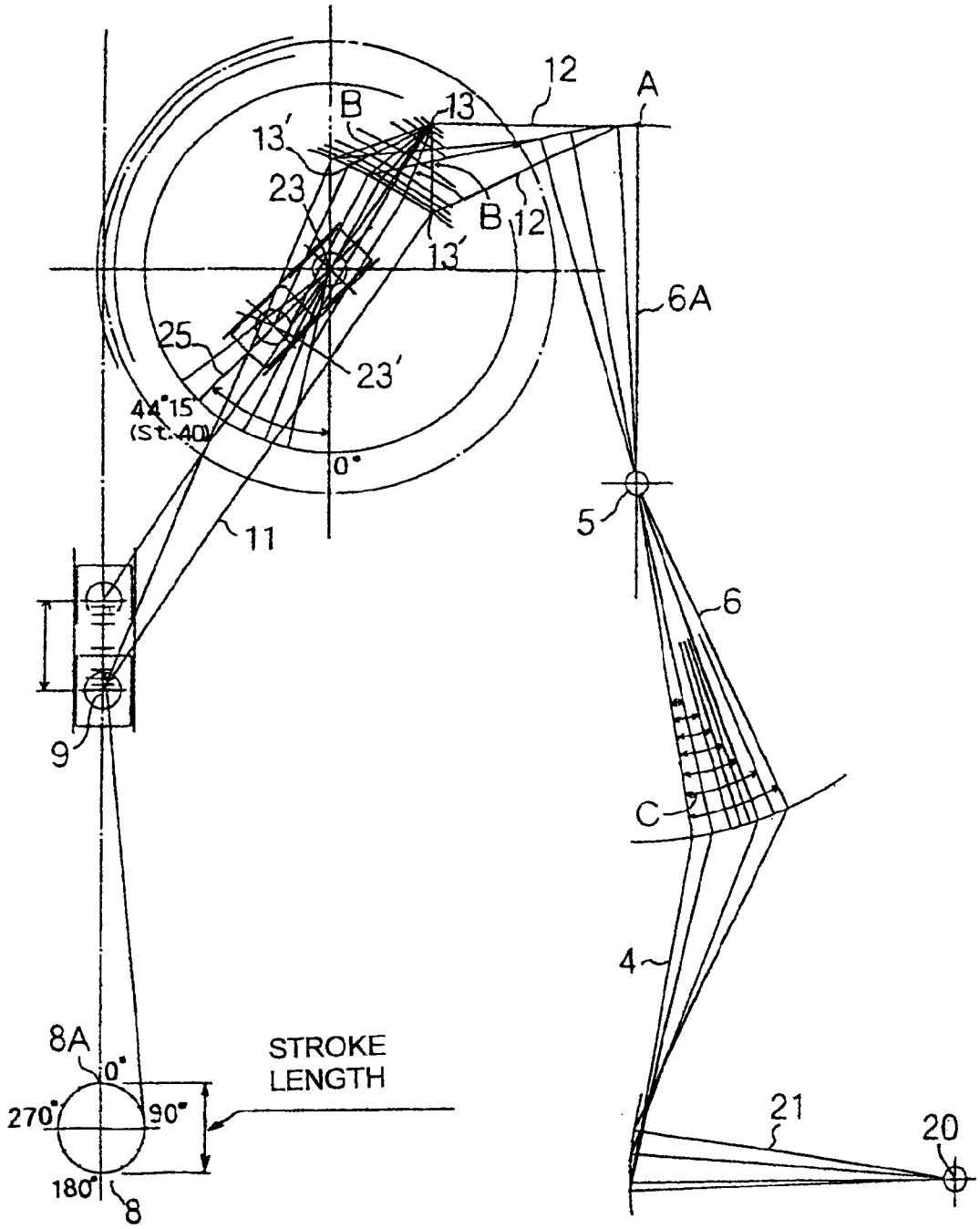
FIG. 7 is a drawing for the purpose of describing a drive mechanism according to a second embodiment of the invention.

FIG. 7 is a drawing which facilitates the description of the various mechanisms of the structures shown in FIG. 6. In this case, the stroke length of slide 3 is 40 mm, and pin 23 of drive link 11 moves along guide groove 25 at an angle of 44° 15'.

The connecting pivot 13 between drive link 11 and drive connecting link 12 moves along a line B, connecting the connecting pivots 13', 13. Connecting pivots 13', 13 correspond to when slide 3 is positioned at the top dead center and the bottom dead center.

Lines B can be drawn corresponding to different incline angles for guide groove 25. With upper toggle link 6, an angle C changes according to the incline angle of guide groove 25, and the stroke length of slide 3 changes.

THIRD EMBODIMENT

Figure 8:
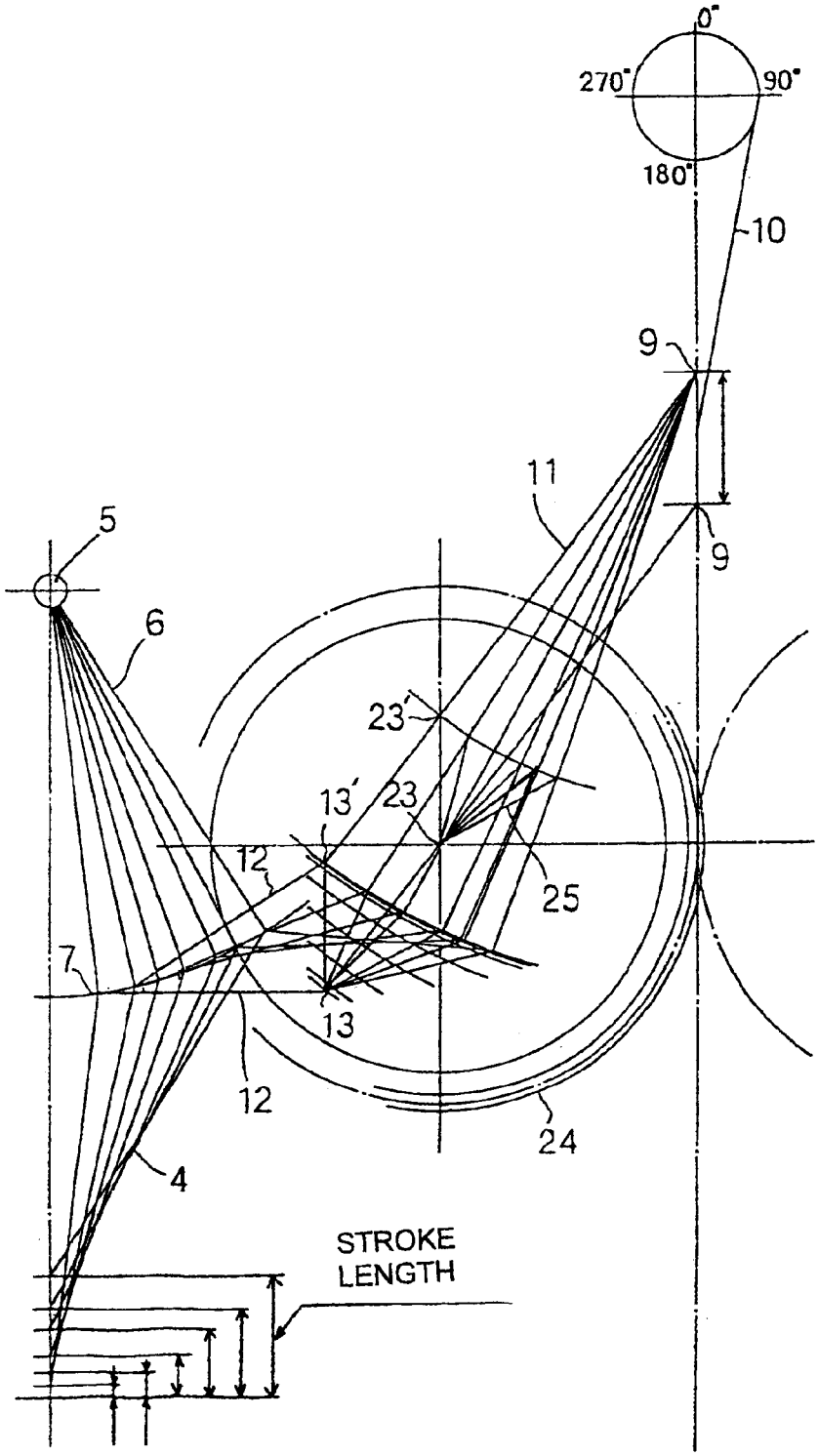
FIG. 8 is a kinematic drawing of a drive mechanism according to a third embodiment of the invention.

A third embodiment of the invention is shown in FIG. 8. In this figure, a slider 9 is disposed below the crank shaft 8. Slider 9 can move up and down. Slider 9 is driven via a connecting rod 10. A central connecting pin 7 is located between an upper toggle link 6 and a lower toggle link 4. Central connecting pin 7 is connected to slider 9 via a direct drive connecting link 12 and a drive link 11. The center of a gear 24 is aligned with the center of pin 23, projected from drive link 11 when slide 3 is at bottom dead center. The above described structure operates in the same manner as the second embodiment of the invention discussed supra.

Figure 11A:
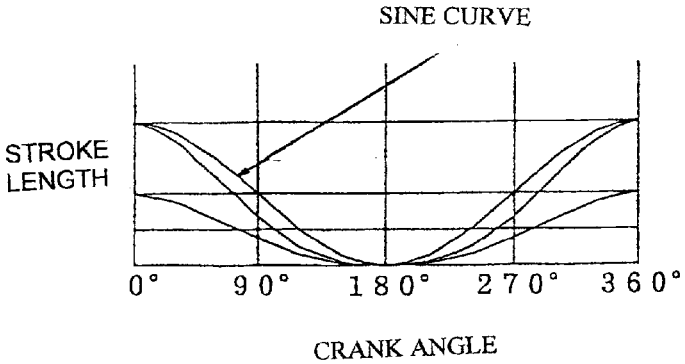
FIG. 11(A) is a slide stroke line graph based on a third embodiment of the invention.

FIG. 11(A) shows a stroke line graph of a slide 3 which is designed according to the third embodiment of the invention. The stroke line graph shows that the stroke line has a gentle curve around the top dead center. The acceleration from the change of direction of slide 3 at the top dead center is small, thus allowing high-speed operation.

As with the second embodiment, the stationary interval at the bottom dead center is an appropriate length. Thus, this structure provides the characteristics of a press that uses toggle links and is suited high-speed operation.

Figure 11B:
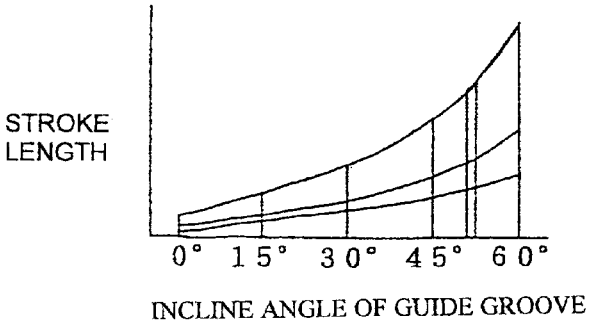
FIG. 11(B) is a figure showing the relationship between an incline angle and a slide stroke based on a third embodiment of the invention.

FIG. 11(B) shows the relationship between the stroke length of slide 3 and the incline angle of the guide groove 25.

FOURTH EMBODIMENT

Figure 9:
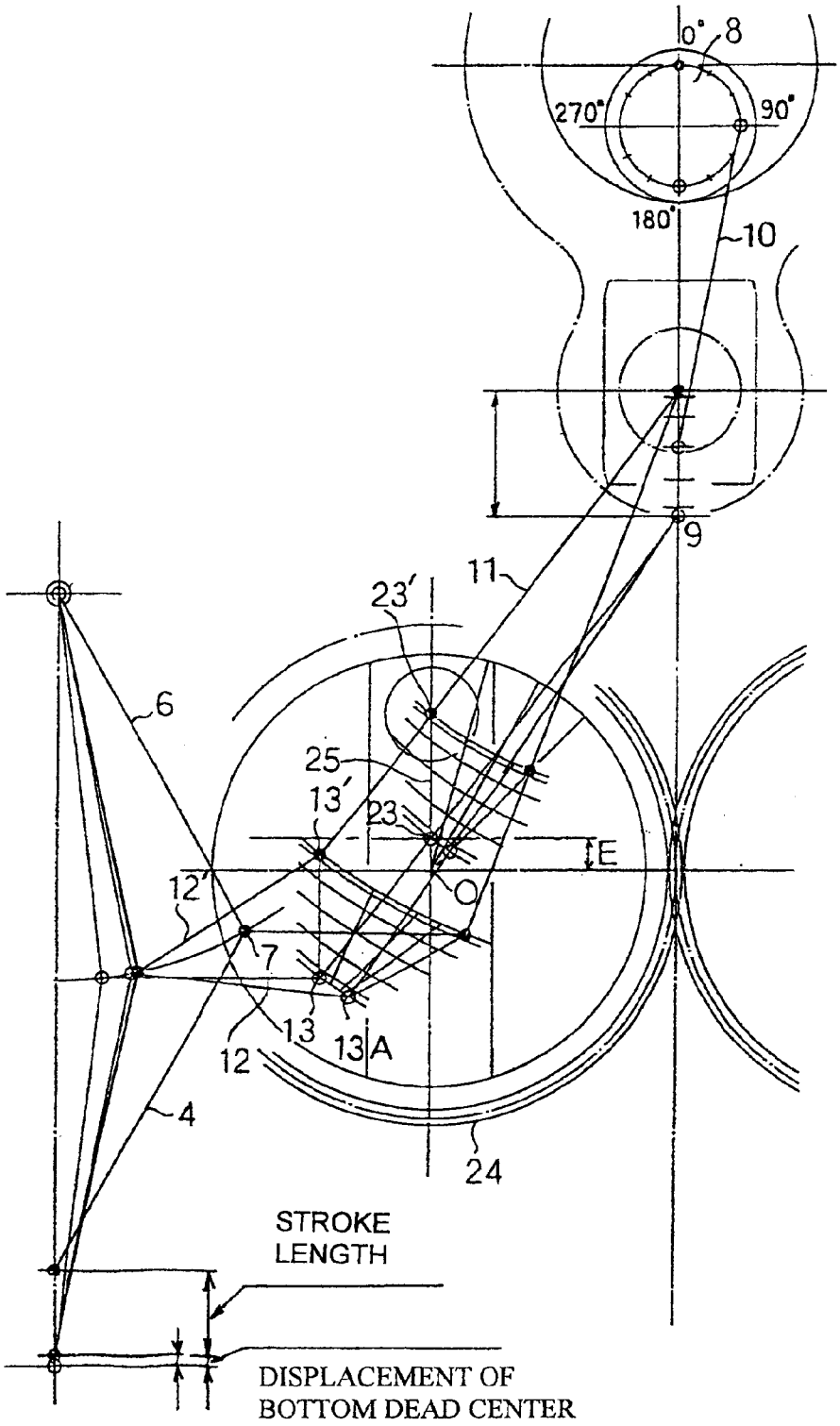
FIG. 9 is a kinematic drawing of a drive mechanism according to a fourth embodiment of the invention.

A fourth embodiment of the invention is shown in FIG. 9. In this figure, slider 9 is disposed below crank shaft 8, and slider 9 is moved up and down via connecting rod 10. Center connection pin 7 connects upper toggle link 6 and lower toggle link 4. Center connecting pin 7 and slider 9 are connected by drive link 11 and drive connecting link 12. The center of pin 23 of drive link 11 is offset from a center O of gear 24 by a vertical offset E.

Pin 23 is guided and restricted by groove 25. Groove 25 is disposed along a diameter of gear 24. Connecting pivot 13 is located between drive link 11 and drive connecting link 12. If the incline angle of guide groove 25 is changed from 0° to, for example, 45°, the offset E will cause connecting pivot 13 to move to connecting pivot 13A at the bottom dead center position of the slide 3, i.e., at the bottom end position of the slider 9. Thus, the bottom dead center of slide 3 is changed by changing the incline angle of guide groove 25.

Figure 12A:
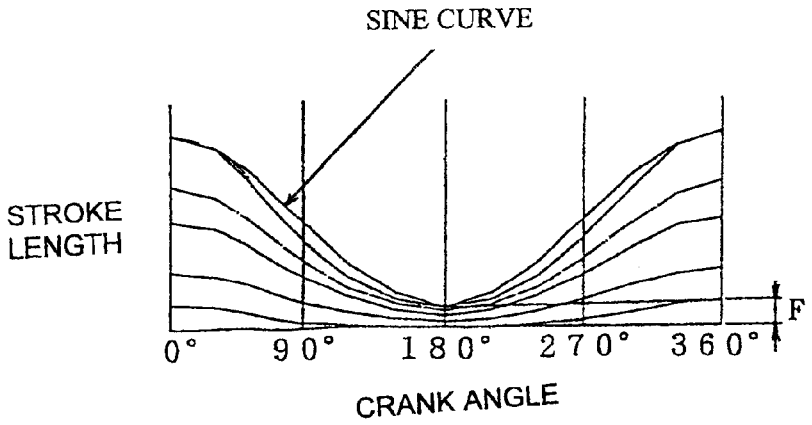
FIG. 12(A) is a slide stroke line graph based on a fourth embodiment of the invention.
Figure 12B:
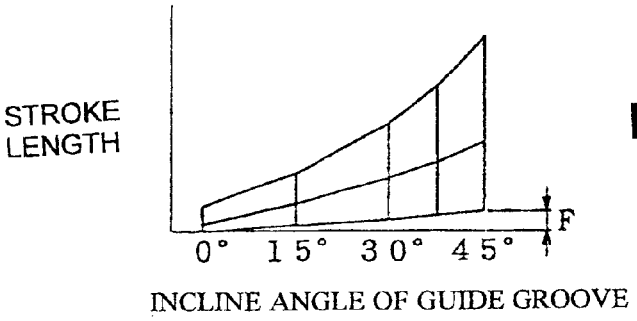
FIG. 12(B) is a figure showing the relationship between an incline angle and a slide stroke based on a fourth embodiment of the invention.

FIG. 12(B) shows the relationship between the bottom dead center of slide 3, the stroke length of slide 3, and the incline angle of guide groove 25. The bottom dead center of slide 3 changes by F. With an appropriate offset E, the incline angle of guide groove 25 can be changed significantly and the stroke length of slide 3 can be adjusted. By making fine adjustments to the incline angle, fine adjustments can be made to the bottom dead center of slide 3.

FIG. 12(A) shows a slide stroke line graph for the fourth embodiment of the invention. There are no major differences between the second embodiment and the third embodiment described above. As shown in the figures, the press according to the fourth embodiment of the invention is also suitable for high-speed operation and can also provide toggle link characteristics.

Referring again to the first embodiment in FIG. 1, third link 18 causes connecting pivot 13 to move in an arcuate direction. In contrast, the motion in the second through fourth embodiments is restricted to a linear direction. However, as shown in FIGS. 10 and 11, the slide stroke line graphs and the relation between the incline angle and the stroke length of slide 3 are similar. A comparison based on detailed analysis will be omitted.

Also, providing an offset between the center of connecting pivot 13 and the center of worm wheel 15 when slide 3 is at bottom dead center is similar to the case shown in FIG. 12. A detailed comparison will be omitted.

Referring to FIGS. 6 through 9, similar results can be obtained if there is left-right symmetry around a vertical line passing through the center of crank shaft 8. Furthermore, presses can be produced so that only the left side or the right side uses the structure described above, or so that there is left-right symmetry.

As described above, the present invention provides a high change ratio of 8–10 for the slide stroke length when the incline angle is adjusted. As the slide stroke line graphs make clear, there is low turning-point acceleration at the top dead center, making the invention suitable for high-speed operation. Also, the stationary interval at the bottom dead center is appropriate. The present invention provides adequate characteristics for presses that use toggle links, and these characteristics are maintained even if the stroke length of the slide is changed.

As described supra, the bottom dead center position can be maintained while the stroke length of the slide is adjusted, fine adjustments can be made on the bottom dead center position, and the stroke length of the slide is adjustable. Changes in the stroke length of the slide and fine adjustments to the bottom dead center positions are performed by adjusting a gear, which is disposed at a position where it is not affected by the precision of the bottom dead center, and by adjusting the rotation angle of a worm wheel. Thus, these adjustments can be made while the press is being operated.

By keeping the stroke length adjustment mechanism fixed during pressing operations, the load applied to the rotating means for the worm wheel and the like can be reduced. Thus, the worm wheel or the like can be made more compact and production costs can be reduced.

Furthermore, by providing a quick-lift feature, the status of the die attached to the press can be easily checked for inspection or the like, thus improving maintenance and inspection.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A press, comprising:

a slider;

said slider is moveable along a vertical axis;

a crank shaft;

a connecting rod;

said connecting rod couples a rotation of said crank shaft to said slider such that said slider moves along said vertical axis in response to a rotation of said crank shaft;

a drive link;

said drive link having one end;

said one end of said drive link is coupled to said slider;

a drive connecting link;

said drive connecting link having one end;

said one end of said drive connecting link is coupled to said drive link;

an upper toggle link;

said upper toggle link having one end and another end;

a fixed pivot;

said upper toggle link is pivotably supported at one point by said fixed pivot;

said one end of said upper toggle link is coupled to said drive connecting link;

a link member;

said another end of said upper toggle link is coupled to said slide via said link member;

a stroke length adjusting mechanism restricting a pivoting motion of a pivot connecting said drive link and said drive connecting link;

wherein said stroke length adjusting mechanism includes a connecting pivot;

said connecting pivot projecting from said drive link;

a third link;

said third link having one end and another end;

said one end of said third link is coupled to said connecting pivot;

a shaft;

a frame;

said shaft is pivotably supported by said frame;

a second arm;

said second arm having one end and another end;

said one end of said second arm is coupled to said shaft;

said another end of said second arm is coupled to said another end of said third link; and rotating means for rotating said shaft.

2. A press described in claim 1 wherein said rotating means includes:

a worm wheel;

said worm wheel is fixed to said shaft;

a worm shaft; and said worm shaft meshing with said worm wheel.

3. A press as described in claim 1, wherein said stroke length adjusting mechanism includes means for fixing said shaft (15A), said means for fixing said shaft including:

a fixing cylinder;

said fixing cylinder is movably fitting with said shaft;

a jaw;

said jaw is disposed on said shaft;

said jaw is adapted to restrict a displacement distance of said fixing cylinder;

a pressure device; and said pressure device is adapted to supply pressurized oil to said jaw and said fixing cylinder.

4. A press as described in claim 2, wherein said stroke length adjusting mechanism includes means for fixing said shaft (15A), said means for fixing said shaft including:

a fixing cylinder;

said fixing cylinder is movably fitting with said shaft;

a jaw;

said jaw is disposed on said shaft;

said jaw is adapted to restrict a displacement distance of said fixing cylinder;

a pressure device; and said pressure device is adapted to supply pressurized oil to said jaw and said fixing cylinder.

5. A press as described in claim 1, wherein said stroke length adjusting mechanism includes:

a pin;

said pin projects from said drive link;

a gear;

a guide groove disposed on said gear;

said guide groove is movably fitted to said pin (23);

said gear having a rotation angle; and gear angle adjustment means for adjusting said rotation angle of said gear.

6. A press as described in claim 1, wherein said stroke length adjusting mechanism includes:

a pin;

said pin projects from said drive link;

a gear;

a guide groove disposed on said gear;

said guide groove is movably fitted to said pin (23);

said gear having a rotation angle; and gear angle adjustment means for adjusting said rotation angle of said gear.

7. A press as described in claim 2, wherein said stroke length adjusting mechanism includes:

a pin;

said pin projects from said drive link;

a gear;

a guide groove disposed on said gear;

said guide groove is movably fitted to said pin (23);

said gear having a rotation angle; and gear angle adjustment means for adjusting said rotation angle of said gear.

8. A press as described in claim 3, wherein said stroke length adjusting mechanism includes:

a pin;

said pin projects from said drive link;

a gear;

a guide groove disposed on said gear;

said guide groove is movably fitted to said pin (23);

said gear having a rotation angle; and gear angle adjustment means for adjusting said rotation angle of said gear.

9. A press as described in claim 4, wherein said stroke length adjusting mechanism includes:

a pin;

said pin projects from said drive link;

a gear;

a guide groove disposed on said gear;

said guide groove is movably fitted to said pin (23);

said gear having a rotation angle; and gear angle adjustment means for adjusting said rotation angle of said gear.

10. A press as described in claim 1, wherein said third link is adapted to move said connecting pivot in a linear motion.

11. A press as described in claim 1, wherein said third link is adapted to move said connecting pivot in an arcuate motion.

12. A press as described in claim 2, wherein said a center axis of said connecting pivot is offset from a center axis of said worm wheel.

13. A press as described in claim 5, wherein said gear angle adjustment means is adapted to provide a low-turning point acceleration when said press is at a top dead center position.

14. A press as described in claim 5, wherein said gear angle adjustment means is adapted to provide a stationary interval when said press is at a bottom dead center position such that said bottom dead center position does not change when said stroke length is adjusted.

* * * * *